US006186616B1

(12) United States Patent
Inoue et al.

(10) Patent No.: US 6,186,616 B1
(45) Date of Patent: Feb. 13, 2001

(54) INK JET HEAD HAVING AN IMPROVED ORIFICE PLATE, A METHOD FOR MANUFACTURING SUCH INK JET HEADS, AND AN INK JET APPARATUS PROVIDED WITH SUCH INK JET HEAD

(75) Inventors: Takashi Inoue; Mineo Kaneko, both of Tokyo; Masayoshi Tachihara, Chofu; Shuichi Murakami, Kawasaki; Michinari Mizutani, Tokyo; Yuichiro Akama, Yokohama, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/161,397

(22) Filed: Sep. 28, 1998

(30) Foreign Application Priority Data

Sep. 30, 1997 (JP) ..... 9-266557

(51) Int. Cl.[7] ..... B41J 2/135
(52) U.S. Cl. ..... 347/45
(58) Field of Search ..... 347/44, 45, 65, 347/63, 20

(56) References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,159,354 | 10/1992 | Hirasawa et al. | 346/140 R |
| 5,164,747 | 11/1992 | Osada et al. | 346/140 R |
| 5,621,524 | 4/1997 | Mitani | 356/338 |
| 5,682,190 | 10/1997 | Hirosawa et al. | 347/94 |
| 5,697,144 | 12/1997 | Mitani et al. | 29/611 |

FOREIGN PATENT DOCUMENTS

| | | | |
|---|---|---|---|
| 195 25 765 | 1/1996 | (DE) | B41J/2/14 |
| 0 771 659 | 5/1997 | (EP) | B41J/2/16 |
| 54-56847 | 5/1979 | (JP) . | |
| 54-161935 | 12/1979 | (JP) . | |
| 59-123670 | 7/1984 | (JP) . | |
| 59-138461 | 8/1984 | (JP) . | |
| 60-71260 | 4/1985 | (JP) . | |
| 61-185455 | 8/1986 | (JP) . | |
| 61-249768 | 11/1986 | (JP) . | |
| 401280566 * | 11/1989 | (JP) | 347/44 |
| 4-10940 | 1/1992 | (JP) . | |
| 4-10941 | 1/1992 | (JP) . | |
| 405077417 * | 3/1993 | (JP) | 347/45 |
| 6-15828 | 1/1994 | (JP) . | |
| 6-344560 | 12/1994 | (JP) . | |
| 8-230195 | 9/1996 | (JP) . | |
| 8-244235 | 9/1996 | (JP) . | |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet head comprises a plurality of discharge pressure generating elements serving as the discharge pressure source for discharging an ink droplet, an orifice plate having a plurality of ink discharge ports corresponding to the respective discharge pressure generating elements formed therefor, an ink supply port for supplying ink and a nozzle wall forming an ink flow path communicating the ink discharge ports with the ink supply port. The orifice plate and the nozzle wall are formed by resin material, and also, a thin metallic film is formed on the outer surface of the orifice plate. If desired, a water-repellent film is formed further on the surface of the thin metallic film. With the metallic film formed on the surface of the orifice plate, the moisture in ink is effectively prevented from being evaporated. Further, with the provision of the metallic film, it becomes possible to perform the eutectoid plating for the formation of the water-repellent film. With the head thus structured, it becomes possible to stably obtain excellent print quality.

6 Claims, 9 Drawing Sheets

INK JET HEAD HAVING AN IMPROVED ORIFICE PLATE, A METHOD FOR MANUFACTURING SUCH INK JET HEADS, AND AN INK JET APPARATUS PROVIDED WITH SUCH INK JET HEAD

BACKGROUND OF THE INVENTION

1. Field of the Invention

The present invention relates to an ink jet head that performs recording or the like on a recording medium by means of the small ink droplets that fly onto it. The invention also relates to a method for manufacturing such heads, and an ink jet apparatus provided with such head as well.

2. Related Background Art

The ink jet recording method is one of the so-called non-impact recording types. The features and advantages of this recording method are that the noise which is generated at the time of recording is small enough to be neglected, while recording is possible on various kinds of recording media at high speeds, and that fixation is also possible on an ordinary paper sheet without any particular treatment given to it, while highly precise images are obtainable at lower costs, among some other advantages. The ink discharge recording method has been rapidly and widely utilized in recent years not only for a printer serving as a peripheral device of a computer, but also, utilized for the printing system of a copying machine, facsimile equipment, word processor, or the like, with such features and advantages as described above.

As the ink discharge method for the general type of ink jet recording type is currently in use widely, there is the method that uses electrothermal converting elements (heaters), and also, there is the one that uses piezoelectric elements (piezo elements). It is possible for both of them to control the discharges of ink droplets by means of electric signals. The principle of the method that uses the electrothermal converting elements is such as to apply electric signals to each of the electrothermal converting elements in order to enable ink around each electrothermal converting element to be boiled instantaneously, and that each of the ink droplets is then discharged at high speeds by the utilization of phase changes of ink that generate the abrupt development of each bubble. Therefore, the method that uses the electrothermal converting elements makes it possible, as its remarkable advantage, to structure the ink jet head with the nozzles that can be formed integrally with ease.

Nevertheless, there is still rooms for improvement for this method, such as to eliminate the voluminal changes of flying droplets due to heat accumulation on the ink jet head, the influence of the cavitation exerted on the electrothermal converting elements at the time of defoaming, among some others.

To make such improvements, there have been proposed ink jet recording methods and ink jet heads as disclosed in the specifications of Japanese Patent Application Laid-Open Nos. 54-161935, 61-185455, 61-249768, 4-10940, and 4-10941, for example. The ink jet recording methods disclosed in these specifications are characterized in that bubbles created on the electrothermal converting elements in response to recording signals are arranged to be in the state where the bubbles are communicated with the air outside through the discharge ports of the head so as to enable ink between each of the discharge ports and electrothermal converting elements to be discharged almost completely. More specifically, a complete ink discharge of the kind becomes attainable by the provision of means for discharging ink droplets having a shorter distance between each of its electrothermal converting elements and discharge ports. With a recording method of the kind, it becomes possible to improve the voluminal stability of flying ink droplets, and the capability of discharging smaller droplets at higher speeds, as well as to improve the durability of electrothermal converting elements by eliminating the influence of cavitation. As a result, highly precise images can be obtained easily.

FIG. 6A is a view schematically showing one example of the fundamental mode of an ink jet head having the droplet discharge means which enables the bubbles created on the electrothermal converting elements in response to recording signals to be communicated with the air outside. This view is partly broken for the illustration on an appropriate surface. FIG. 6B is a cross-sectional view of the head, taken along line 6B—6B in FIG. 6A. This ink jet head comprises many numbers of electrothermal converting elements 1 arranged on an Si substrate 4; nozzle walls 6 that form the ink flow paths 12 each positioned corresponding to each of the electrothermal converting elements 1; and an orifice plate 5 having ink discharge ports 2 as an integrated member. Further, on the surface of the orifice plate 5, a water-repellent film 11 is formed. Also, on the Si substrate 4, an ink supply port 3 is open from its back side for supplying ink.

FIGS. 7A to 7I are cross-sectional views which schematically illustrate each step of manufacture of the ink jet head represented in FIGS. 6A and 6B. (These views correspond to the representation of FIG. 6B.) In other words, on the Si substrate 4 (FIG. 7A), which is provided with the electrothermal converting elements 1 and the driving wiring (not shown) on it, a soluble resin layer 7 is formed (FIG. 7B). Then, this layer is removed with the exception of the ink flow path pattern (FIG. 7C). Further, the resin layer 7 is covered by the covering resin layer (the resin material to structure the orifice plate 5 and the nozzle walls 6) (FIG. 7D). Then, the portions corresponding to the discharge ports are removed (FIG. 7E). Subsequently, the water-repellent agent is applied to the surface of the covering resin layer (that is, to the surface of the orifice plate 5) in order to form the water-repellent film 11 (FIG. 7F). With the masking provided for other portions than the discharge ports 2, the excessive water-repellent film 11 is removed in the interior of the discharge ports 2 (FIG. 7G). Also, the ink supply port 3 is formed on the Si substrate (FIG. 7H). Lastly, the resin layer 7 is eluted for the formation of each ink path 12 (FIG. 7I), and then, the electrical connection, and the like are arranged to enable the electrothermal converting elements to be driven. Thus, the ink jet head is obtained as shown in FIG. 6A.

For such a head as shown in FIG. 6A, the distance between each of the electrothermal converting elements 1 and discharge ports 2 is made shorter so that the bubble is communicated with the air outside. In other words, the thickness of the orifice plate 5 is made extremely small (8 $\mu$m for the example shown in FIG. 6B). Also, in order to make the thickness small, the material that forms the orifice plate 5 and nozzle walls 6 should be the one which can be processed with ease comparatively. Usually resin material is adopted.

However, if the orifice plate 5 and nozzle walls 6 are formed by resin material (which is generally gas permeable), while the orifice plate 5 should be made thinner, the moisture in ink in the interior of the head is subjected to the easier evaporation to the atmosphere through the orifice plate 5. As a result, ink in the head may become overly viscous, and the print quality tends to be affected. Also, there is a fear that the air outside may enter the interior of the head to create bubbles. Such an influence of the kind may be exerted not only in the mode of the head where electrothermal converting elements are used, but also, in the mode where some other ink discharge principle is adopted, such as the use of piezo elements, when the orifice plate is formed by resin material.

Also, in the steps of manufacture shown in FIGS. 7F and 7G (after the application of water-repellent agent and the mask removal), the water-repellent agent may in some cases remain on the inner surface of the discharge ports 2. Then, the meniscus of ink is subjected to breakage by the presence of such residue of water-repellent agent, which may affect the print quality in some cases. Here, on the other hand, in accordance with the knowledge obtained by the inventors hereof, it is found desirable to apply the water-repellent film 11 up to the edges of the discharge ports 2 in order to obtain good print quality. However, in the step of manufacture shown in FIG. 7G, masking is provided for the portions other than the discharge ports 2 for the prevention of the water-repellent agent from remaining inside the discharge ports 2. This makes it difficult to allow the water-repellent film to be formed up to the edges of the discharge ports 2.

SUMMARY OF THE INVENTION

The present invention is designed in consideration of each of the problems described above. It is an object of the invention to provide an ink jet head capable of preventing the moisture of ink from being evaporated in order to stably obtain excellent print quality, and also, to provide a method for manufacturing such heads, as well as an ink jet apparatus provided with such head.

It is another object of the invention to provide an ink jet head for which no water-repellent agent remains inside the ink discharge ports, while the water-repellent film can be formed up to the edges of the discharge ports thereof, and also, to provide a method for manufacturing such heads, as well as an ink jet apparatus provided with such head.

It is still another object of the invention to provide an ink jet head comprising a plurality of discharge pressure generating elements serving as the discharge pressure source for discharging ink droplets; an orifice plate having a plurality of ink discharge ports corresponding to the respective discharge pressure generating elements formed therefor; an ink supply port for supplying ink; and nozzle walls forming ink flow paths communicating the ink discharge ports with the ink supply port. The orifice plate and the nozzle walls are formed by resin material, and also, a thin metallic film is formed on the outer surface of the orifice plate. (If desired, a water-repellent film is formed further on the surface of the thin metallic film.)

It is a further object of the invention to provide a method for manufacturing ink jet heads, each provided with a plurality of discharge pressure generating elements serving as the discharge pressure source for discharging ink droplets; an orifice plate having a plurality of ink discharge ports corresponding the respective discharge pressure generating elements formed therefor; an ink supply port for supplying ink; and nozzles walls forming ink flow paths communicating the ink discharge ports with the ink supply port, the orifice plate and the nozzle walls being formed by resin material, which comprises the step of forming a thin metallic film on the outer surface of the orifice plate. (If desired, this method further comprises the step of forming a water-repellent film further on the surface of the thin metallic film.)

It is still a further object of the invention to provide an ink jet apparatus at least comprising a head of the present invention, which is provided with ink discharging ports facing a recording medium to discharge ink onto the recording surface thereof; and a member for mounting the head thereon.

In accordance with the present invention, the metallic film formed on the orifice plate prevents the moisture in ink from being evaporated to the air outside effectively. Therefore, even when the orifice plate and nozzle walls are formed by resin material, and the orifice plate is formed extremely thin, for example, there is no problem of the overly viscous ink or the like.

Also, in accordance with the present invention, the metallic film formed on the orifice plate makes it possible to perform the eutectoid plating for the formation of water-repellent film. By the process of the eutectoid plating, there is no possibility that the water-repellent agent is allowed to reside remaining in the interior of the ink discharge ports, while the water-repellent film can be formed in good condition up to the edges of the discharge ports. In this respect, there is a head, among those conventionally available, which is provided with the orifice plate or the like formed by metallic material by the application of casting precipitation. However, if the eutectoid plating should be processed on such a head, even the reverse side of the orifice plate (that is, the ink flow path side) or the like is also plated inevitably, for example. In other words, in accordance with the present invention, the orifice plate itself is formed by resin material, and then, the metallic film is formed on the outer surface of the resin orifice plate. Therefore, only the surface of the orifice plate is energized, and only the surface thus energized is plated in good condition by the application of the eutectoid plating.

DETAILED DESCRIPTION OF THE PREFERRED EMBODIMENTS

Hereinafter, with reference to the accompanying drawings, the description will be made of the preferred embodiments in accordance with the present invention.

Figure 1A:
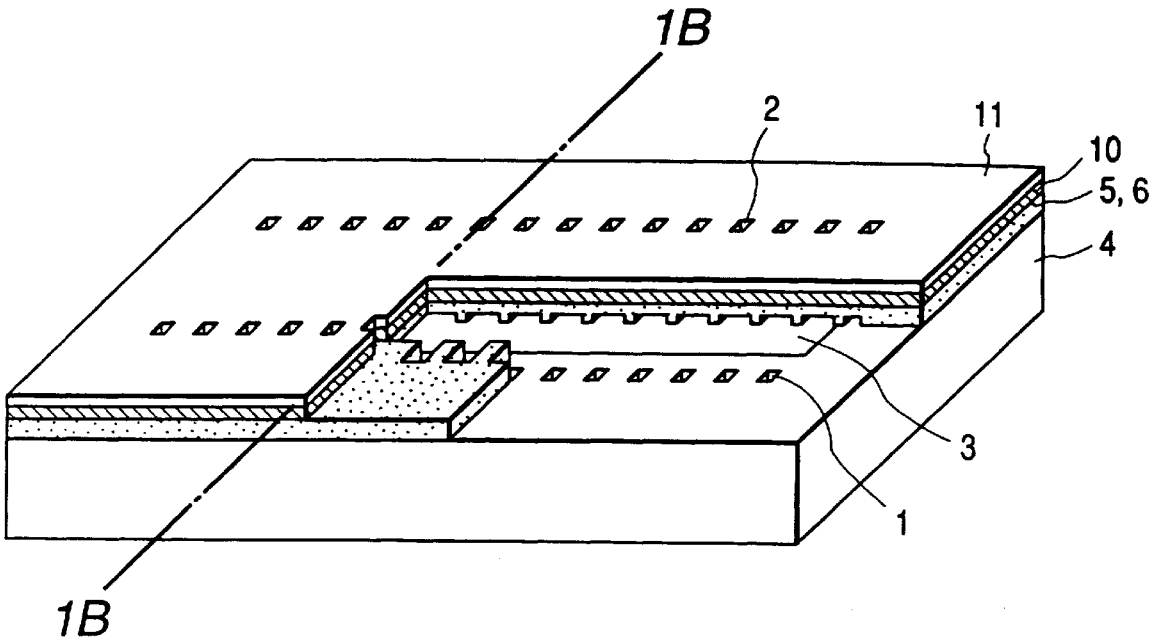
FIG. 1A is a view which schematically shows the one example of the fundamental mode of an ink jet head of the present invention, having the ink droplet discharge means which communicates each of the bubbles with the air outside.
Figure 1B:
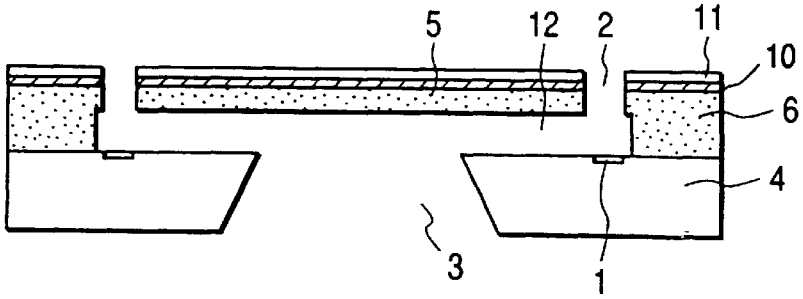
FIG. 1B is a cross-sectional view thereof, taken along line 1B—1B in FIG. 1A.

FIG. 1A is a view which schematically shows the one example of the fundamental mode of an ink jet head of the present invention, having the ink droplet discharge means which communicates each of the bubbles with the air outside. For the illustrate thereof, the surface is broken appropriately. FIG. 1B is a cross-sectional view thereof, taken along line 1B—1B in FIG. 1A. Here, for FIGS. 1A and 1B, and each of other figures, the electrical wiring or the like which is needed to drive the electrothermal converting elements 1 is not shown.

For the head shown in FIG. 1A and 1B, many numbers of electrothermal converting elements (heater and others) 1 are arranged in two lines on the Si substrate 4, which serve as the sources of discharge pressure used for discharging ink droplets, and the wiring (not shown) is also patterned as required to drive those electrothermal converting elements 1. Also, on the Si substrate 4, there are provided the nozzle walls 6 that form the ink flow paths 12 each on the positions corresponding to each of the electrothermal converting elements 1, and the orifice plate 5 having a plurality of ink discharge ports 2 formed therefor on each of the positions corresponding to each of the electro-thermal converting elements 1 (which correspond to each of the ink flow paths 12) as an integrated member. This member is formed by non-conductive resin. Here, the nozzle walls 6 exist inclusively between the Si substrate 4 and the orifice plate 5 and in contact with both of them in order to secure each of the ink flow paths 12 that communicate each of the discharge ports 2 and the supply port 3.

On the orifice plate 5, the metallic film 10 is coated. Further on the surface of the metallic film 10, the water-repellent film 11 is formed. Also, between the two lines of the electrothermal converting elements 1, the ink supply port 3 is provided from the back side of the Si substrate 4 (the surface opposite to the electrothermal transducing 1 side) for supplying ink. This head is driven by electric signals and arranged to discharge ink droplets in the direction perpendicular to the surface of the Si substrate 4.

In FIGS. 1A and 1B, the metallic film 10 prevents the moisture of ink effectively from being evaporated to the air outside. Also, by the application of the eutectoid plating, it is possible to form the water-repellent film 11 in good condition.

Also, by making the thickness of the orifice plate 5 extremely small (8 $\mu$m for the present embodiment), the distance between the electrothermal converting elements 1 and the discharge ports 2 is made shorter so that the bubbles created on the electrothermal converting elements are allowed to be communicated with the air outside. Then, the voluminal stability of flying ink droplets are improved to make recording with as small droplets as possible at higher speeds, and to eliminate the influence of cavitation for the improved durability of electrothermal converting elements. As a result, it becomes easier to obtain highly precise images. Here, more specifically, smaller ink droplets (50 pl or less) can be discharged, thus the amount of discharged ink droplets being dependent almost only on the amount of ink residing between each of the electrothermal converting elements and discharge ports. In other words, the amount of each discharge of ink droplet is determined mostly by the way in which the nozzle portion of the head is structured. Therefore, it becomes easier to output high quality images without unevenness.

FIGS. 2A to 2E are cross-sectional views which schematically illustrate each step of manufacture of a method for manufacturing the ink jet head represented in FIGS. 1A and 1B. (These steps correspond to the details shown in FIG. 1B).

Figure 2A:
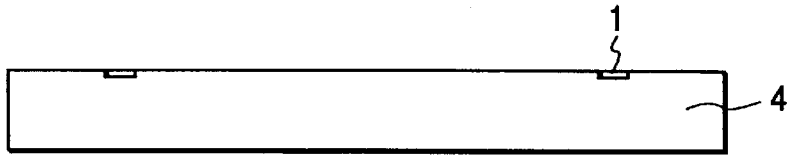
FIGS. 2A, 2B, 2C, 2D and 2E are cross-sectional views which schematically illustrate each step of manufacture of a method for manufacturing the ink jet head represented in FIGS. 1A and 1B.
Figure 2B:
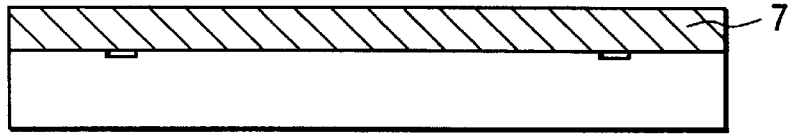
Figure 2C:
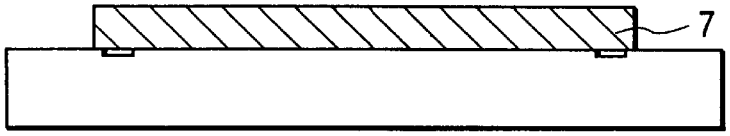
Figure 2D:
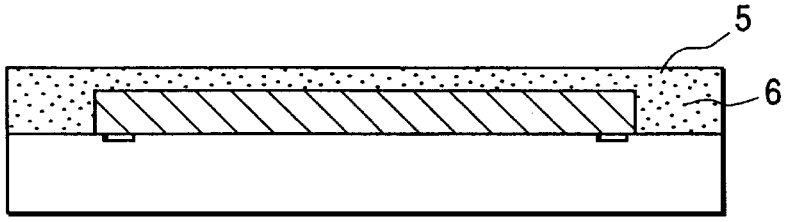

At first, by use of the semiconductor manufacturing processes or the like, the Si substrate 4 is produced by patterning a plurality of electrothermal converting elements 1 shown in FIG. 2A and the wiring (not shown) required to drive them on the Si wafer. Then, as shown in FIG. 2B, soluble resin layer 7 is formed on the Si substrate 4. Further, by use of the photoresist method or the like, the resin layer 7, which is on the portions other than the portions corresponding to the ink flow path pattern on it, is removed as shown in FIG. 2C. After that, as shown in FIG. 2D, the resin layer 7 having the ink flow path pattern on it is covered by non-conductive covering resin layer (which is the resin material used for the integral formation of the orifice plate 5 and nozzle walls 6). For this covering resin layer, epoxy resin or the like should preferably be used.

Figure 2E:
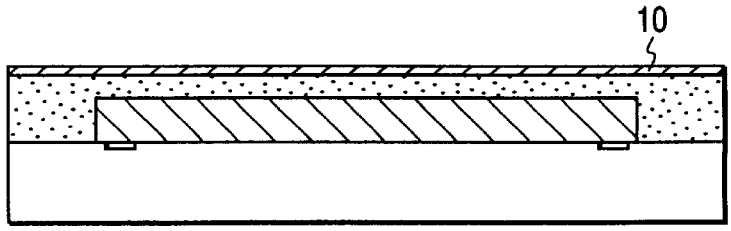

Then, as shown in FIG. 2E, the metallic film 10 is formed on the surface of the covering resin layer (that is, on the surface of the orifice plate 5). There is no particular restriction as to the film formation means of the metallic film 10. Although any means may be adoptable without problem, but the vapor deposition is preferable, for example, because the thickness is obtainable in the order of several hundreds of Å by use thereof. There is then no possibility, either, that the thickness of the orifice plate 5 is made larger to exert any essential influence on the ink discharges. (If the film is provided by means of plating or the like, its thickness tends to become several micron. Thus, the intended effect that may be obtainable by the provision of the thinner orifice plate 5 cannot be obtained sufficiently by the head shown in FIGS. 1A and 1B).

There is no particular restriction on the material and thickness of the metallic film 10. It is good enough if only the film should be formed so as to prevent the moisture in ink from being evaporated to the air outside. Also, the film should preferably provide conductivity or the like that makes the process of the eutectoid plating possible for the formation of the water-repellent film 11. Here, for the metallic material, it is preferable to use Pt, Au, or the like. Then, there is no corrosion that may be caused by use of ink.

As in the present embodiment, it is preferable to form the metallic film 10 all over the surface of the orifice plate 8 (the entire surface of the orifice) in consideration of the required steps of manufacture. However, the present invention is not necessarily limited thereto. It should be good enough to provide the metallic film 10 partly on the surface of the orifice plate 8 if only the moisture in ink is prevented from being evaporated to the air outside as desired. Also, if the water-repellent film 11 is formed by means of the eutectoid plating, the partial coverage of the metallic film 10 is adoptable without any problem as far as the water-repellent film 11 thus formed functions as effectively as intended.

Figure 2F:
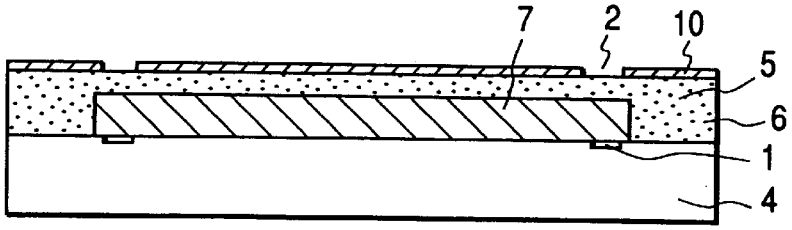
FIGS. 2F, 2G, 2H, 2I and 2J are cross-sectional views which schematically illustrate each step of manufacture of the method for manufacturing the ink jet head in continuation from FIGS. 2A, 2B, 2C, 2D and 2E.

Now, as shown in FIG. 2F, the metallic film 10, which covers the portions corresponding to the discharge ports 2, is removed. There is no particular restriction on the removal method therefor, but etching or the like is desirable.

Figure 2G:
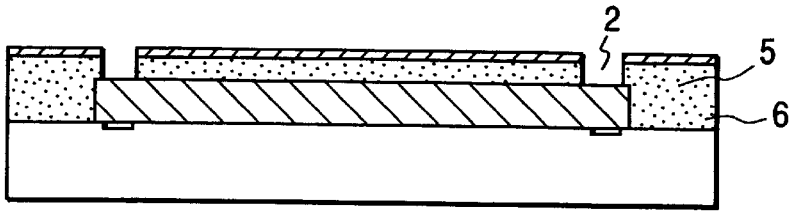

Then, as shown in FIG. 2G, the covering resin layer on the portions which are not covered by the metallic film 10 (that is, the portions corresponding to the discharge ports 2) is removed to form the discharge ports 2. It is desirable to perform this removal by the plasma ashing method or the like. At this juncture, the metallic film which remains still unremoved functions as mask as it is.

Figure 2H:
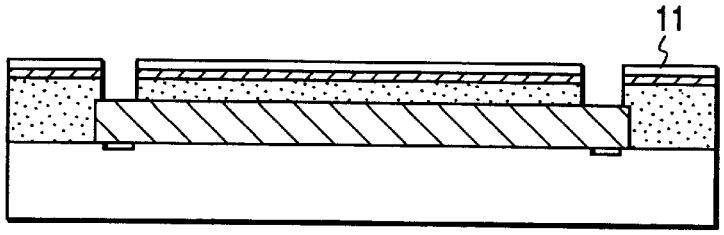
Figure 2I:
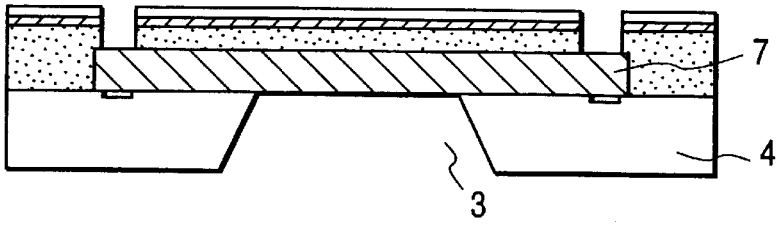

Now, as shown in FIG. 2H, the water-repellent film 11 is formed on the surface of the metallic film 10. It is desirable to form the water-repellent film 11 by the process of the eutectoid plating (dispersion plating) using metal and water-repellent resin (resin containing an appropriate component having water-repellency or the like). By the process of the eutectoid plating, the water-repellent film 11 is formed only on the portions covered by the metallic film 10, that is, only on the portions that can be energized. As a result, there is no possibility that water-repellency is given to the interior of the discharge ports 2, but the water-repellent film can be formed easily up to the edges of the discharge ports 2 at the same time.

Particularly, it is preferable to perform the eutectoid plating using Ni and fluororesin, because this plating produces the formation of an extremely strong water-repellent film 11. (It is also preferable to make the thickness of the water-repellent film 11 one $\mu$m or less by adjusting the plating timing and the density of applied current).

Figure 2J:
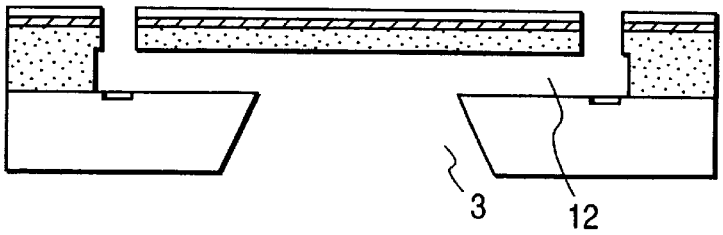

Then, as shown in FIG. 21, the ink supply port 3 is formed from the back side of the Si substrate 4 by the application of the chemical etching or the like. More specifically, it is preferable to use the anisotropic etching using strong alkaline solution (KOH, NaOH, tetramethyl ammonium hydroxide (TMAH) or the like). Subsequently, as shown in FIG. 2J, the resin layer 7 is eluted in order to form each of the ink flow paths 12. After the completion of each of these steps, the Si wafer having each of the Si substrates 4 formed on it is cut to obtain the ink jet head shown in FIGS. 1A and 1B after effectuating the electrical connection or the like to drive the electrothermal converting elements 1.

It is preferable to adopt the aforesaid method for the manufacture of the head having the ink discharge means that enables bubbles, which are created on the electrothermal converting elements in response to recording signals, to be communicated with the air outside as disclosed in the specifications of Japanese Patent Application Laid-Open Nos. 4-10940 and 4-10941 in particular.

In accordance with the embodiment of the head manufacture method as shown in FIGS. 2A to 2J, the metallic film 10 on the portions corresponding to the discharge ports 2 is removed after the metallic film 10 has been formed (FIG. 2F). Then, the discharge ports are formed on the covering resin layer by the application of the plasma ashing or the like with the metallic film 10 as the mask pattern as it is (FIG. 2G). With such steps of manufacture, the metallic film can remain unremoved up to the discharge port 2 edges. Then, together with the subsequent process of the eutectoid plating (FIG. 2F), it becomes easier to make the portions water-repellent up to the edges of the discharge ports 2.

Figure 3:
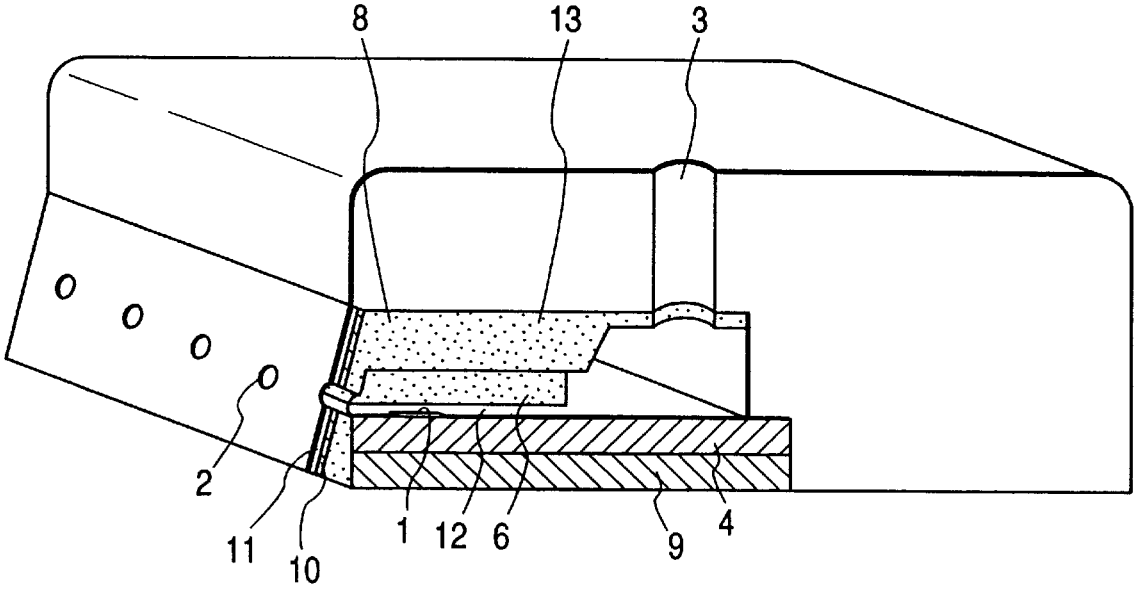
FIG. 3 is a view which schematically shows another example of the fundamental mode of an ink jet head in accordance with the present invention.

Preferably, the ink jet head of the present invention should be the one which is provided with the ink droplet discharge means that enables bubbles to be communicated with the air outside as shown in FIGS. 1A and 1B. However, the present invention is not necessarily limited to such head. FIG. 3 is a view which schematically shows another example of the head.

For the head shown in FIG. 3, the electrothermal converting elements 1 are arranged on the Si substrate 4 on the aluminum base plate 9. Then, the required wiring (not shown) is patterned for the driving of the electrothermal converting elements 1. Also, on the Si substrate 4, there are arranged, the grooved ceiling plate integrally formed by the molding formation with the orifice plate 8 having the discharge ports 2, the nozzle walls 6 that form the ink flow paths 12, the common liquid chamber, the supply port, and others for the formation of the head.

Then, on the surface of the orifice plate 8 of the ceiling plate 13, the metallic film 10 and the water-repellent film 11 are arranged. The metallic film 10 prevents the moisture in ink from being evaporated to the air outside. Also, the process of the eutectoid plating makes it possible to provide the water-repellent film 11 in good condition.

Figure 4A:
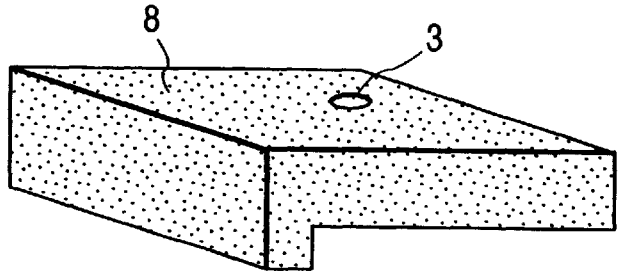
FIGS. 4A, 4B, 4C, 4D and 4E are views which schematically illustrate each step of manufacture of the method for manufacturing the ink jet head represented in FIG. 3.
Figure 4B:
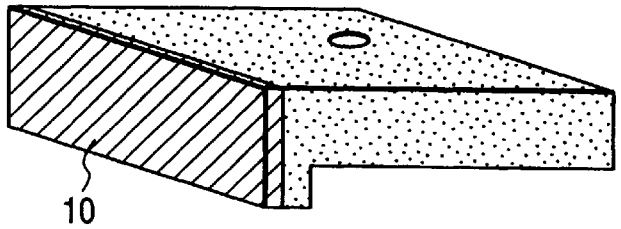
Figure 4C:
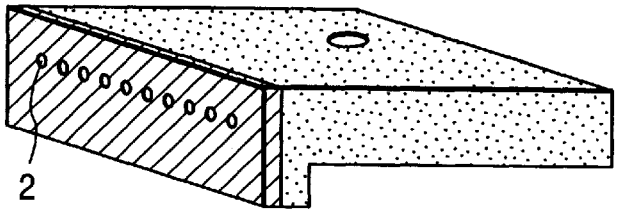
Figure 4D:
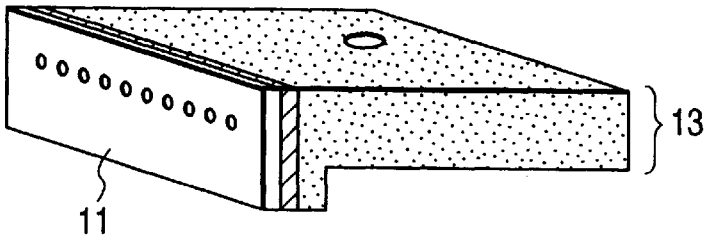
Figure 4E:
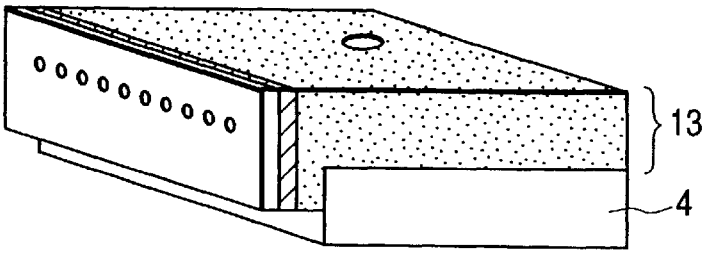

FIGS. 4A to 4E are views which schematically illustrate the steps of manufacture of the method for manufacturing the ink jet head represented in FIG. 3. At first, as shown in FIG. 4A, the orifice plate 8, the common liquid chamber, the supply port 3, and others are formed integrally by the molding formation. Then, as shown in FIG. 4B, the metallic film 10 is formed on the surface of the orifice plate 8 by the application of the vapor deposition, for example, in the same manner as described in conjunction with FIGS. 1A and 1B. (Here, as described earlier, it may be possible to adopt other film formation methods as well.) Then, as shown in FIG. 4C, the grooves that becomes discharge ports 2 and the nozzles are formed by the irradiation of laser beam or the like. Subsequently, the eutectoid plating or the like as described earlier is performed to form the water-repellent film 11 as shown in FIG. 4D, and complete the grooved ceiling plate 13. Now, as shown in FIG. 4E, the grooved ceiling plate 13 is bonded to the Si substrate 4 having a plurality of electrothermal converting elements 1 and the patterned driving circuit on it for the formation of the head.

Of the liquid discharge methods, the present invention demonstrates an excellent effect with respect to the recording head and recording apparatus of the so-called ink jet recording type, which performs recording by forming flying droplets particularly by the utilization of thermal energy. Regarding the typical structure and operational principle of such method, it is preferable for the present invention to adopt those which can be implemented using the fundamental principle disclosed in the specifications of U.S. Pat. Nos. 4,723,129 and 4,740,796, for example. This method is applicable to the so-called on-demand type recording and a continuous type recording as well.

To briefly describe this recording method, discharge signals are supplied from a driving circuit to electrothermal converting elements each disposed on a liquid (ink) retaining sheet or liquid path. In accordance with recording information, at least one driving signal is given in order to provide recording liquid (ink) with a rapid temperature rise so that film boiling phenomenon, which is beyond nuclear boiling phenomenon, is created in the liquid, thus generating thermal energy to cause film boiling to be created on the thermoactive surface of the recording head. Since a bubble can be formed from the recording liquid (ink) by means of the driving signal given to an electrothermal converting element one to one, this method is effective particularly for the on-demand type recording method. By the development and contraction of the bubble, the liquid (ink) is discharged through each discharge port to produce at least one droplet. The driving signal is more preferably in the form of pulses because the development and contraction of the bubble can be effectuated instantaneously and appropriately. The liquid (ink) is discharged with quicker response. The driving signal in the form of pulses is preferably such as disclosed in the specifications of U.S. Pat. Nos. 4,463,359 and 4,345,262. In this respect, the temperature increasing rate of the thermo-active surface is preferably such as disclosed in the specification of U.S. Pat. No. 4,313,124 for an excellent recording in a better condition.

As the structure of the recording head, there are included in the present invention, the structure such as disclosed in the specifications of U.S. Pat. Nos. 4,558,333 and 4,459,600 in which the thermal activation portions are arranged in a curved area, besides those which are shown in each of the above-mentioned specifications wherein the structure is arranged to combine the discharging ports, liquid paths, and the electrothermal converting elements (linear type liquid paths or right-angled liquid paths).

In addition, the present invention is effectively applicable to the structure disclosed in Japanese Patent Application Laid-Open No. 59-123670 wherein a common slit is used as the discharging ports for plural electrothermal converting elements, and to the structure disclosed in Japanese Patent Application Laid-Open No. 59-138461 wherein an aperture for absorbing pressure waves of thermal energy is formed corresponding to the discharge ports.

Further, as a recording head for which the present invention can be utilized effectively, there is the full-line type recording head whose length corresponds to the maximum width of a recording medium recordable by such recording apparatus. For the full-line type recording head, it may be possible to adopt either a structure whereby to satisfy the required length by combining a plurality of recording heads or a structure arranged by one recording head integrally formed.

In addition, the present invention is effectively applicable to an exchangeable recording head of a chip type that can be electrically connected with the apparatus main body, the ink supply therefor being made possible from the apparatus main body, when mounted on the apparatus main body or to the use of a cartridge type recording head provided integrally for the recording head itself.

Figure 5:
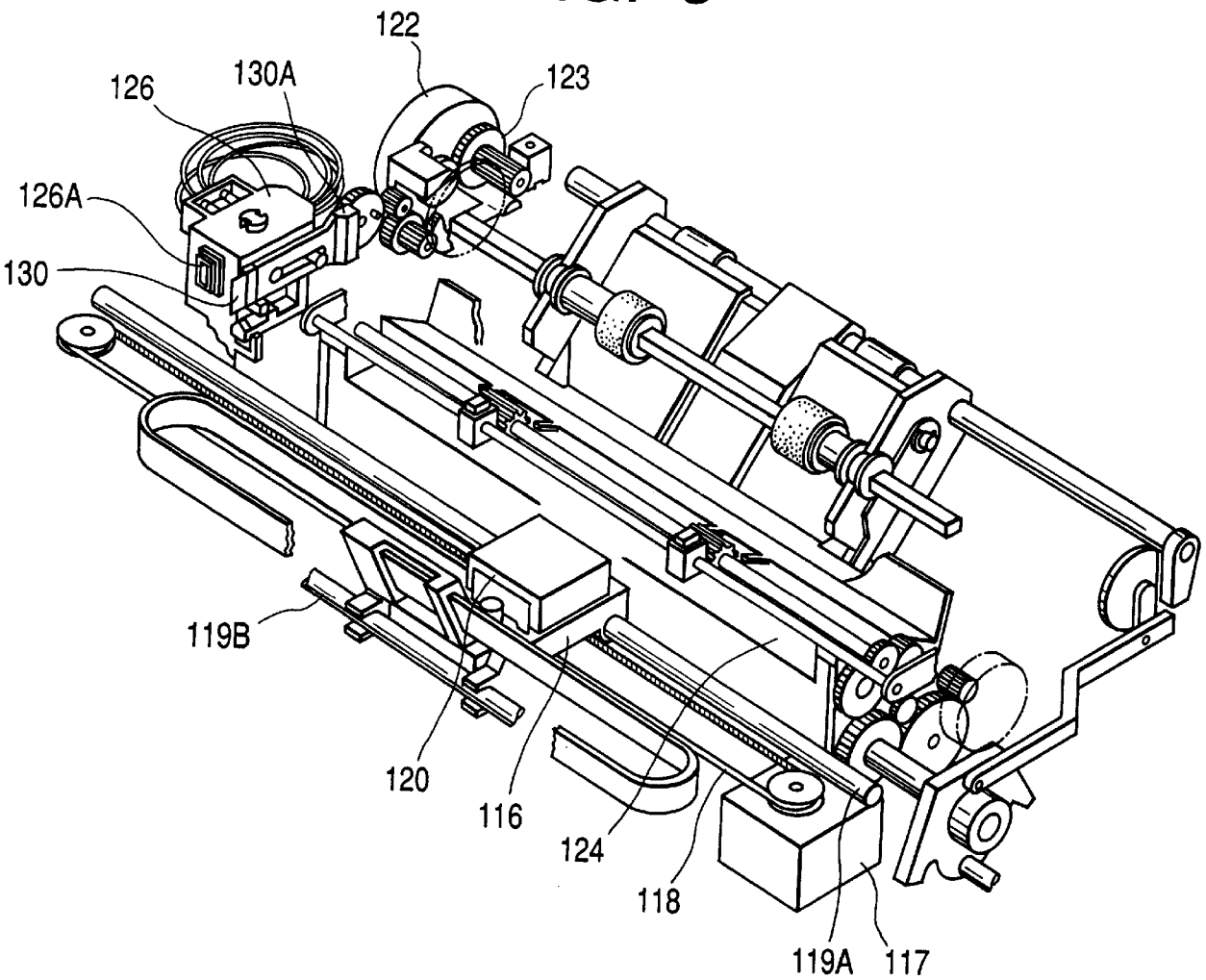
FIG. 5 is a perspective view which shows one example of an ink jet apparatus provided with the head of the present invention.
Figure 6A:
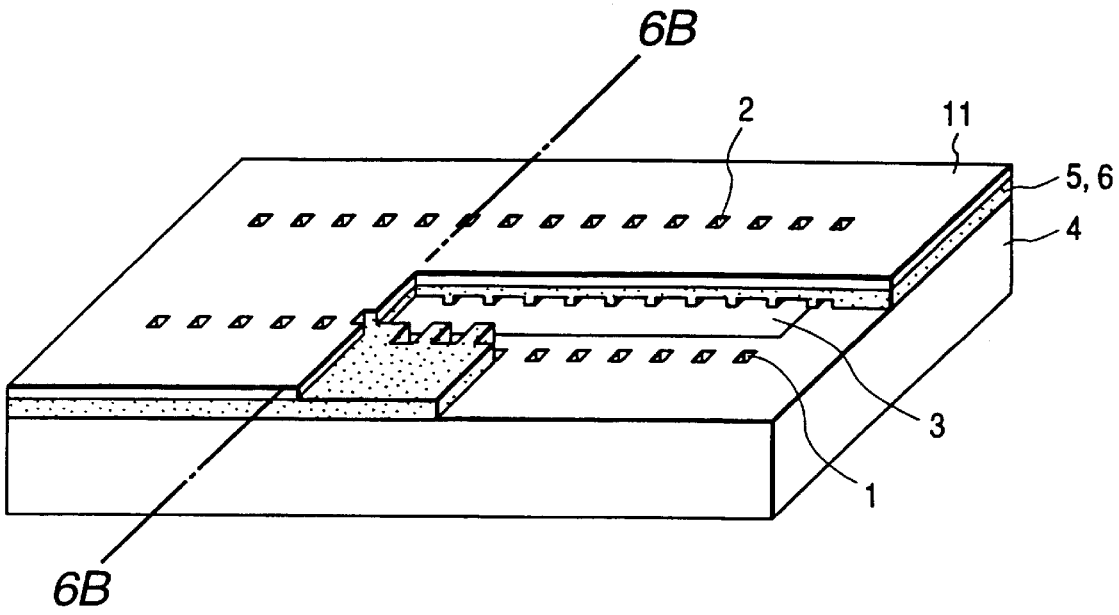
FIG. 6A PRIOR ART
FIG. 6A is a view which schematically shows the fundamental mode of the conventional ink jet head having the ink discharge means that communicates bubbles with the air outside.
Figure 6B:
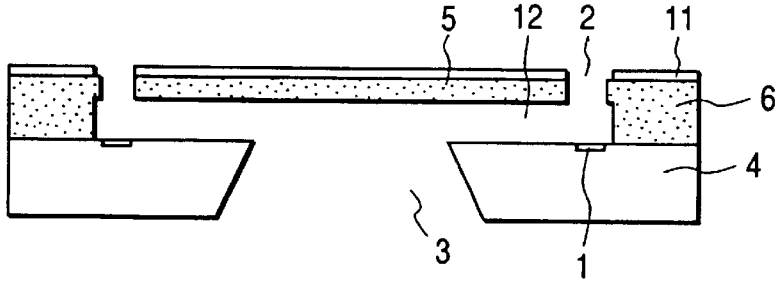
FIG. 6B PRIOR ART
FIG. 6B is a cross-sectional view there of taken along line 6B—6B in FIG. 6A.
Figure 7A:
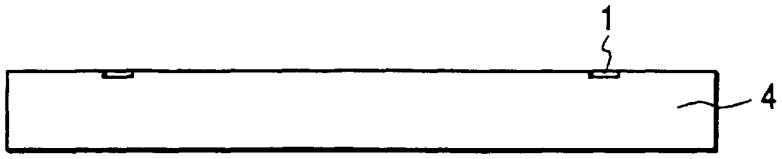
FIG. 7A PRIOR ART
FIGS. 7A, 7B, 7C, 7D and 7E are cross-sectional views which schematically illustrate each step of manufacture of the method for manufacturing the ink jet head represented in FIGS. 6A and 6B.
Figure 7B:
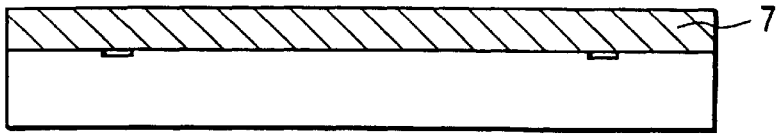
FIG. 7B PRIOR ART
Figure 7C:
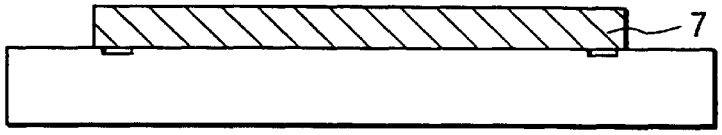
FIG. 7C PRIOR ART
Figure 7D:
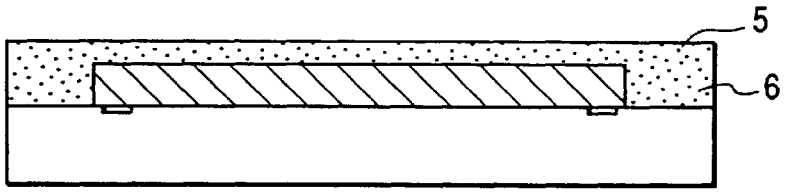
FIG. 7D PRIOR ART
Figure 7E:
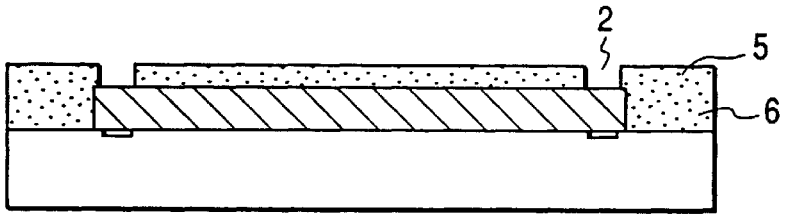
FIG. 7E PRIOR ART
Figure 7F:
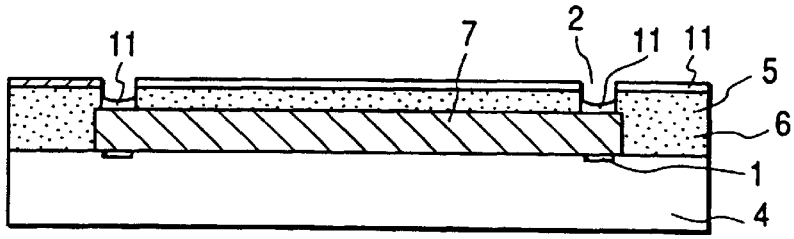
FIG. 7F PRIOR ART
FIGS. 7F, 7G, 7H and 7I are cross-sectional views which schematically illustrate each step of manufacture of the method for manufacturing the ink jet head in continuation from FIGS. 7A, 7B, 7C, 7D and 7E.
Figure 7G:
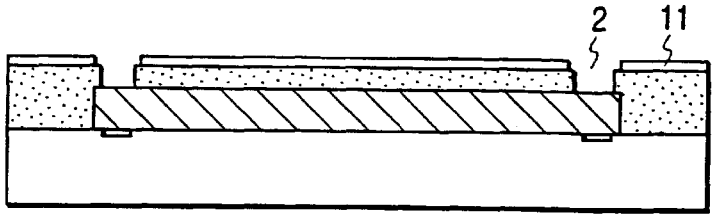
FIG. 7G PRIOR ART
Figure 7H:
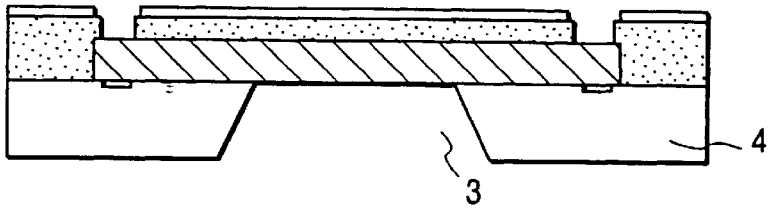
FIG. 7H PRIOR ART
Figure 7I:
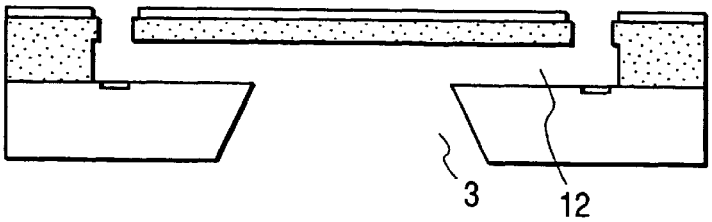
FIG. 7I PRIOR ART

FIG. 5 is a perspective view which shows the external appearance of one example of an ink jet recording apparatus (IJRA) which mounts on it the recording head obtainable in accordance with the present invention as an ink jet head cartridge (IJC).

In FIG. 5, a reference numeral 120 designates the ink jet head cartridge (IJC) provided with the nozzle that discharge ink to the recording surface of a recording sheet carried onto a platen 124, and 116, the carriage HC that holds the IJC 120. The carriage HC is connected with a part of a driving belt 118 that transmits the driving power of the driving motor 117, and slides on the two guide shafts 119A and 119B which are arranged in parallel to each other to reciprocate over the entire width of the recording sheet.

A reference numeral 126 designates the head recovery device which is arranged on a position facing the home position of the IJC 120 on one end of its traveling path. The head recovery device 126 is operated by the driving power of the motor 122 through its power transmission mechanism 123 in order to perform capping of the IJC 120. Interlocked with the capping of the IJC 120 by use of the cap unit 126A of the head recovery device 126, ink is sucked by an appropriate suction means arranged in the interior of the head recovery device 126 or ink is compressed to flow by an appropriate compression means arranged in the ink supply path to the IJC 120. Thus, the discharge recovery process is executed such as to forcibly exhaust ink from the discharge ports to remove the overly viscous ink in the nozzles. Also, at the termination of recording operation or the like, capping is performed to protect the IJC.

A reference numeral 130 designates the blade formed by silicone rubber as a wiping member arranged on the side face of the head recovery device 126. The blade 130 is held by the blade supporting member in a cantilever fashion. As in the case of the head recovery device 126, the blade operates by use of the motor 122 and the power transmission mechanism 123 to be able to engage with the discharge surface of the IJC 120. In this manner, at an appropriate timing of the recording operation of the IJC or after the discharge recovery process using the head recovery device 126, the blade 130 is allowed to extrude into the traveling path of the IJC 120 to wipe off dew condensation, wetting, or dust particles adhering to the discharge surface of the INK 120 along with the traveling operation of the IJC 120.

Now, hereunder, the description will be made of the embodiments in accordance with the present invention.

Embodiment 1

In accordance with the procedures shown in FIGS. 2A to 2J, the ink jet head structured as shown in FIGS. 1A and 1B is manufactured. For the present embodiment, the orifice plate 5 and the nozzle walls 6 are formed by epoxy resin. The metallic film 10 is formed by means of the Pt deposition (the film thickness: approximately several hundreds of Å). With the metallic film 10 serving as the mask pattern, the plasma ashing is executed, and then, the water-repellent film 11 is formed by means of the eutectoid plating process using Ni and fluororesin (the water-repellent film thickness: approximately 1 $\mu$m or less). The nozzle intervals are 300 dpi in line on one side. The thickness of the orifice plate 5 is 8 $\mu$m (or together with the thicknesses of the metallic film and the water-repellent film, this thickness should be approximately 9 $\mu$m or less).

Then, the head of the present embodiment is driven at discharge frequency of 10 kHz using Canon black color ink (surface tension 47.8 dyn/cm, viscosity 1.8 cp, and pH 9.8) as the evaluation ink.

For comparison, a head is manufactured without the provision of metallic film 10, but by applying water-repellent agent directly to the surface of the orifice plate 5 for the formation of the water-repellent film 11, and after masking, the water-repellent agent is removed. Then, the head thus produced is driven in the same condition as the present embodiment.

After the comparison between them, it is confirmed that the present embodiment has been improved in the accuracy of impact points of the recording liquid on the recording sheet. Also, after filling ink in both heads, and capping them, both of them are left intact for five days under the environment of 30° C./15%. After that, printing is performed for further examination. As a result, whereas the conventional head is even disabled to discharge several shots of liquid droplets properly at the outset, the head of the present embodiment discharges ink exactly in good condition.

As described above, it has been confirmed that the head of the present embodiment is superior to the conventional head in the accuracy of impact positions of discharged ink droplets, as well as in the stability of discharges with the passage of time.

Embodiment 2

With the nozzle intervals at 360 dpi pitches, an ink jet head structured as shown in FIG. 3 is manufactured in the process procedures shown in FIGS. 4A to 4E. As in the first embodiment, the head of the present embodiment and the conventional head are examined for the comparative evaluation (with the exception of the discharge frequency which is changed to 7 kHz). Then, also as in the first embodiment, the head of the present embodiment is superior to the conventional one in the accuracy of impact positions of discharged ink droplets, as well as in the stability of discharges with the passage of time.

As has been described above, with the metallic film formed on the surface of the orifice plate, the moisture in ink is prevented from being evaporated to make the excellent print quality stably obtainable in accordance with the present invention. Further, with the provision of the metallic film, it becomes possible to perform the eutectoid plating for the formation of the water-repellent film. With this eutectoid plating process, no water-repellent agent is allowed to reside remaining in the interior of discharge ports, while the film formation is made up to the edges of the discharge ports in good condition. In this manner, it is possible to obtain the excellent print quality.

With the formation of the metallic film and water-repellent film on the orifice plate as described above, the substantial thickness of the orifice plate does not change very much. Therefore, when discharging ink, no essential influence is exerted on the amount of ink residing between each of the electrothermal converting elements and discharge ports. As a result, it becomes possible to secure the excellent discharge performance of the head shown in FIGS. 1A and 1B.

What is claimed is:

1. An ink jet head comprising:

a plurality of discharge pressure generating elements serving as the discharge pressure source for discharging an ink droplet;

an orifice plate having a plurality of ink discharge ports corresponding to said respective discharge pressure generating elements formed therefor;

an ink supply port for supplying ink;

a nozzle wall forming an ink flow path communicating said ink discharge ports with said ink supply port, said orifice plate and said nozzle wall being formed by resin material, a thin metallic film having been vapor deposited onto only a side surface which becomes an outer surface of said orifice plate; and a water-repellent film formed by eutectoid plating a metal and a water-repellent resin onto a surface of the thin metallic film after removing the ink discharge port portion of the thin metallic film.

2. An ink jet head according to claim 1, wherein said discharge pressure generating elements are electrothermal converting elements, and a distance between said electrothermal converting elements and said ink discharge ports is short so as to enable a bubble created on said electrothermal converting elements to be communicated with an air outside.

3. An ink jet apparatus comprising at least:

a head according to claim 1 provided with an ink discharging ports facing a recording medium to discharge ink onto the recording surface thereof; and a member for mounting said head thereon.

4. An ink jet head according to claim 1, wherein said metal and said water-repellant resin for said eutectoid plating are nickel and a fluororesin, respectively.

5. An ink jet head according to claim 1, wherein said discharge pressure generating elements are disposed at a position facing said ink discharge ports.

6. An ink jet head according to claim 1, wherein said discharge pressure generating elements are disposed at a position intersecting said ink discharge ports at an angle of approximately 90°.

* * * * *

UNITED STATES PATENT AND TRADEMARK OFFICE

CERTIFICATE OF CORRECTION

PATENT NO. : 6,186,616 B1
DATED : February 13, 2001
INVENTOR(S) : Takashi Inoue et al.

It is certified that error appears in the above-identified patent and that said Letters Patent is hereby corrected as shown below:

Column 1,
Line 47, "rooms" should read -- room --.

Column 3,
Line 56, "the" should read -- to the --; and
Line 58, "nozzles" should read -- nozzle --.

Column 4,
Line 61, "there of" should read -- thereof --.

Column 5,
Line 1, "are" should read -- 7J are --; and
Line 15, "illustrate" should read -- illustration --.

Column 6,
Line 31, "but" should be deleted; and
Line 38, "micron." should read -- microns. --.

Column 12,
Line 22, "an" should be deleted; and
Line 28, "water-repellant" should read -- water-repellent --.

Signed and Sealed this

Second Day of April, 2002

*Attest:*

*Attesting Officer*

JAMES E. ROGAN
*Director of the United States Patent and Trademark Office*